US005431610A

United States Patent [19]

Miller

[11] Patent Number: 5,431,610

[45] Date of Patent: Jul. 11, 1995

[54] FACIAL MUSCLE EXERCISE APPARATUS

[76] Inventor: Warren G. Miller, 6701 Moravia Park Dr., Baltimore, Md. 21237

[21] Appl. No.: 104,893

[22] Filed: Aug. 12, 1993

[51] Int. Cl.[6] ..... A63B 23/03

[52] U.S. Cl. ..... 482/11; 482/122; 601/38

[58] Field of Search ..... 73/379.02, 379.03; 482/11, 121, 122, 123, 128; 128/777; 601/38; 602/32, 36

[56] References Cited

U.S. PATENT DOCUMENTS

| | | | |
|---|---|---|---|
| 1,466,559 | 8/1923 | Purdy | 482/11 |
| 1,953,088 | 4/1934 | Purdy | 482/11 |
| 3,805,771 | 4/1974 | Wright | 482/11 |
| 3,924,850 | 12/1975 | Robertson | 482/11 |
| 4,718,662 | 1/1988 | North | 482/11 |
| 4,744,556 | 5/1988 | Shaffer | 482/11 |
| 5,035,420 | 7/1991 | Beeuwkes, III et al. | 482/11 |
| 5,205,803 | 4/1993 | Zemitis | 482/122 |

FOREIGN PATENT DOCUMENTS

| | | | |
|---|---|---|---|
| 267383 | 12/1968 | Australia | 482/121 |
| 151137 | 9/1920 | United Kingdom | 482/11 |

*Primary Examiner*—Richard J. Apley
*Assistant Examiner*—Jeanne M. Clark
*Attorney, Agent, or Firm*—Browdy and Neimark

[57] ABSTRACT

A facial muscle exercise device includes a mouthpiece which fits into the mouth over the lower jaw and teeth, which mouthpiece is connected via an elastic member to a handle which is pressed down by the user to create tension against the lower jaw. The lower jaw may then be exercised by up and down motion or thrusting forward and back or from side to side. Proper use of this device will cause the muscles in the face, chin and neck to become toned and conditioned, eliminating fatness below the chin and wrinkles.

6 Claims, 2 Drawing Sheets

FACIAL MUSCLE EXERCISE APPARATUS

FIELD OF THE INVENTION

The present invention relates in general to muscle exerciser apparatus and, more particularly, to jaw and facial muscle exerciser apparatus in which tension is applied from below in order to produce a downward force on the lower jaw such that the muscles of the lower jaw may be exercised by countering such downward force.

BACKGROUND OF THE INVENTION

It is well known that in the aging process of the human body the facial skin tends to droop and become flabby with the development of wrinkles in the skin and hollowness in certain facial regions. Many persons desire to retain or restore the firmness and evenness of the facial contour which is associated with youth. Surgical face lifting has long been a common practice and is effective to tighten the facial skin. However, as a result of tightening the skin by this technique, the skin is caused to support the underlying muscle. If it is lacking in tone, it is lengthened and droopy and is the major contributing cause of wrinkled and droopy facial skin. Since the skin is not adapted to support the underlying muscles, this creates an even stronger tendency for the skin to droop and wrinkle. Consequently, the surgical face lift provides a temporarily tightened facial skin with the appearance of a lift of the facial contour; however, it also starts the process of drooping and wrinkling over again.

It is understood that the contour of the face is determined by the condition of the muscles beneath the skin. In the head and face of every typical human being there is a group of 56 separate muscles. Of all the muscles in the body, the jaw muscle is the most powerful. Yet, the only time this muscle is used and hence is taxed is when one chews, smiles, grimaces and talks. When the muscles underlying the facial skin are strong and have good tone, the skin is tight and smooth and the face has a youthful appearance. However, as the facial muscles lose tone, by reason of aging or lack of proper exercise, the muscles elongate and droop or sag. This results in a change of facial contour with attendant wrinkles in the skin.

In recent years, there have been a number of innovations in exercising apparatus to enable people to utilize various body muscles in a capacity in which they would otherwise not be exercised. However, very little, if anything at all, has been done in this area in order to permit people to exercise jaw and facial muscles.

It has been recognized that exercising facial muscles and particularly jaw muscles is highly beneficial for persons who have sustained jaw injuries. More importantly, it has also been recognized that exercising of jaw muscles and other facial muscles will have a tendency to decrease fatness beneath the skin of the human being. Consequently, facial muscle exercising has a tendency to actually increase the appearance of the individual by decreasing not only the fatness, but the wrinkles in the chin. Even more so, it has been found that the muscles which are strained by movement of the jaw when properly exercised, will decrease wrinkles around the eyes, due to the fact that it will cause a conditioning of the skin in the area around the eyes.

It has been recognized that certain people have a tendency to grind their upper and lower teeth inadvertently as a result of tension or other emotional strain. This grinding of the teeth, while utilizing muscle activity, is not really effective in exercising jaw muscles inasmuch as the action which is created is only a sliding or grinding action between upper and lower molar teeth. However, there has been some theory that this situation could be alleviated somewhat by at least exercising jaw muscles.

The problem heretofore was how to produce an effective force on the face muscles in order to tax them sufficiently to bring about the proper conditioning and toning results which are desired. In the prior art, several devices have been developed for exercising the jaw and facial muscles. The U.S. Pat. No. 1,466,559 to Purdy discloses an exercise device comprising a bite plate which is gripped between the teeth of the user. The plate is connected by means of a spring which may be connected to the wall or to a rigid handle. The jaw is exercised by pulling the head away from the wall to which the spring is fixed thus creating impulses transmitted to the teeth in order to produce a strain thereon which strain gives the several organs of the mouth and head a proper exercise to maintain the necessary circulation therein.

U.S. Pat. No. 1,953,088 to Purdy has a similar effect but creates resistance both when the user moves his head back and also when the user moves his head forward.

U.S. Pat. No. 1,851,865 to Ptacek and U.S. Pat. No. 4,280,696 to Ramon both disclose exerciser apparatus for enabling exercising of facial muscles and jaws through movement of the jaws. In this device, receptacles to receive the upper teeth and the lower teeth respectively are connected by means of a torque spring mechanism. The jaw and facial muscles are exercised by squeezing on a pair of arms with the teeth against the action of the biasing means.

U.S. Pat. No. 4,744,556 to Shaffer relates to an isometric muscle exerciser which includes a member which is clenched between the teeth and another member which presses against the lower jaw and neck muscles underneath the chin, thus acting to strengthen the masseter and related jaw and neck muscles.

Other devices such as those of Homsy, U.S. Pat. No. 4,955,367 and Beeuwkes, III, U.S. Pat. No. 4,909,502, are for the purpose of causing oscillation of the mandible.

All of these prior art devices require that the jaw muscles be exercised while the teeth are clenched or cause exercise of the jaw muscles by means of a unidirectional opening and closing of the jaw. None of the prior art devices allow exercise of a full range of motion of the jaw muscles.

SUMMARY OF THE INVENTION

Accordingly it is an object of the present invention to resolve the deficiencies of the prior art.

It is another object of the present invention to provide an exercise device which will allow the proper conditioning and toning of facial muscles.

It is a further object of the present invention to provide a device which will create downward tension against the lower jaw against which the jaw can be exercised in a number of directions.

These and other objects of the present invention are accomplished by means of the present device which includes a mouthpiece which fits into the mouth over the lower jaw and teeth which mouthpiece is connected by means of an elastic member such as a BUNGEE cord to a handle which is pressed down by the user to create tension against the lower jaw. The lower jaw may then be exercised by up and down motion or thrusting forward and back or from side to side. Proper use of this device will cause the muscles in the face, chin and neck to become toned and conditioned eliminating fatness below the chin and wrinkles.

DETAILED DESCRIPTION OF PREFERRED EMBODIMENTS

The exercise device 10 of the present invention comprises three main components: a mouthpiece 12, a handle 13 and a connecting body portion 18.

Figure 6:
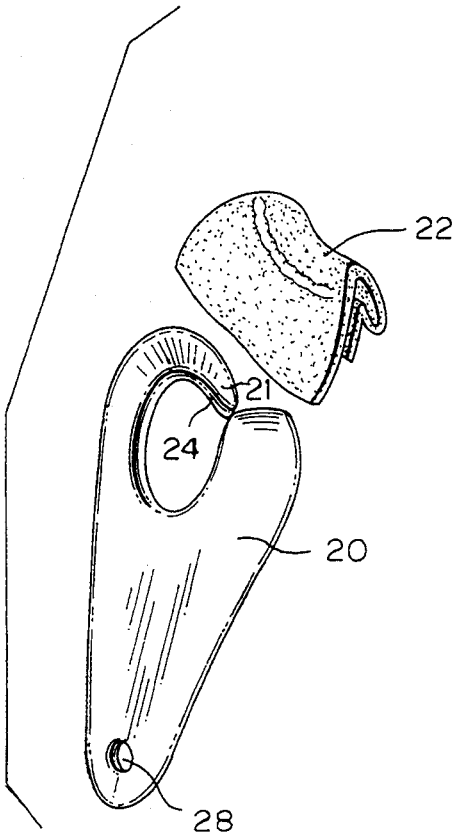
FIG. 6 is a disassembled view of the mouthpiece of the invention.
Figure 7:
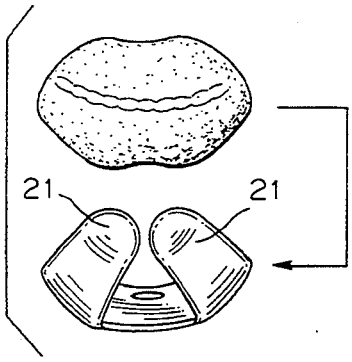
FIG. 7 is a disassembled top plan view of the mouthpiece of FIG. 6.
Figure 8:
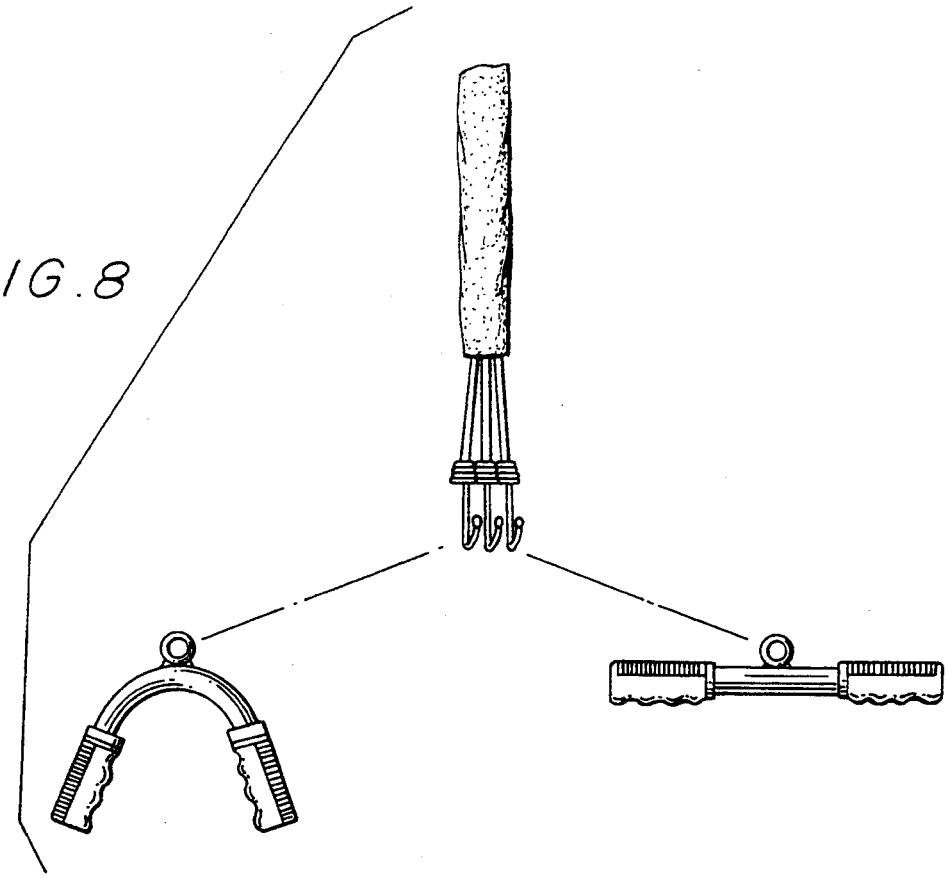
FIG. 8 is a disassembled view of the handle attachment of the present invention showing two alternative handle designs which may be attached to the spring mechanism.

The mouthpiece 12, shown in greater detail in FIGS. 6 and 7, preferably is composed of a sheet metal core component 20 and a plastic overlay 22. The sheet metal core 20 has two prongs 21 formed at the top thereof. The core piece 20 may be stamped from a flat sheet of metal with the appropriate shape. The prongs 21 are then bent over to form the shape of a hook, such as shown at 24. The entire metal core 20 is then bent around a substantially vertical axis to give it a curved shape, best seen in FIG. 7, which is intended to correspond to the approximate curvature of the front of the lower jaw. The plastic overlay 22 is designed to correspond to the shape of the core 20 and cover it with a soft plastic suitable for being received in the mouth. Preferably, the plastic of the cover 22 is a thermoplastic elastomer designed such that, when being placed in very hot (near boiling) water, the thermoplastic elastomer becomes soft and pliable. At this point, when the user places the appliance into the mouth and bites down on it with a moderate amount of force, this leaves a permanent dental impression of the upper and lower teeth. This is done in order to securely fit the appliance to the user's mouth, so that a tight as well as comfortable fit will result.

At the bottom of the mouthpiece 12 is a hole 28 which may be used to attach the mouthpiece to the body portion 18.

Figure 3:
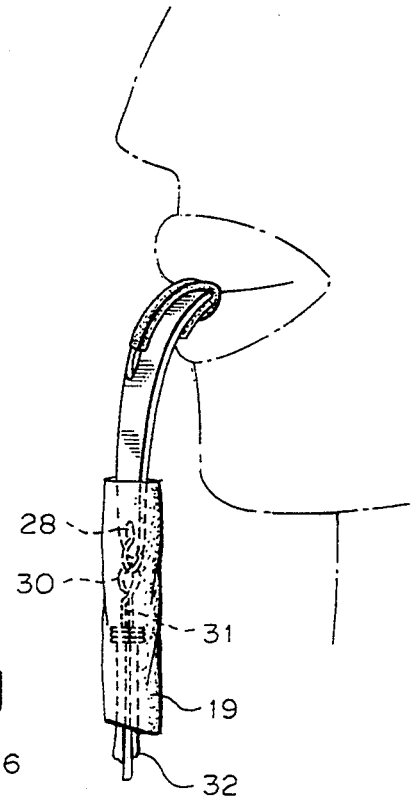
FIG. 3 is a side view of the device along lines 3—3 of the device of FIG. 1 illustrating the position of the mouthpiece in the mouth when in use.

As can be seen, for example, in FIG. 3, the body portion 18 includes one or more spring-like devices 32 which will stretch upon tensile stress and are biased to return to their starting length. Elastic members 32 are BUNGEE cords or other such devices. Three such BUNGEE cords are shown in the illustrated embodiment, although more or fewer such BUNGEE cords may be used depending upon the amount of resistance which is desired to be developed by the device.

At the top of the center section 18, the BUNGEE cords 32 are connected to the mouthpiece 12 by means of a connecting link 30 which passes through the opening 28 of the mouthpiece 12. Hooks 31 connected to the top of the BUNGEE cords 32 are connected to the link 30. A protective sheath 19 may be disposed over the elastic members 32 and also cover the connecting links 30 and a portion of the mouthpiece as shown in FIG. 3.

Elastic members 32 preferably end at their bottom portion in hooks 16. Preferably, each BUNGEE cord 32 ends in a single hook 16.

Figure 1:
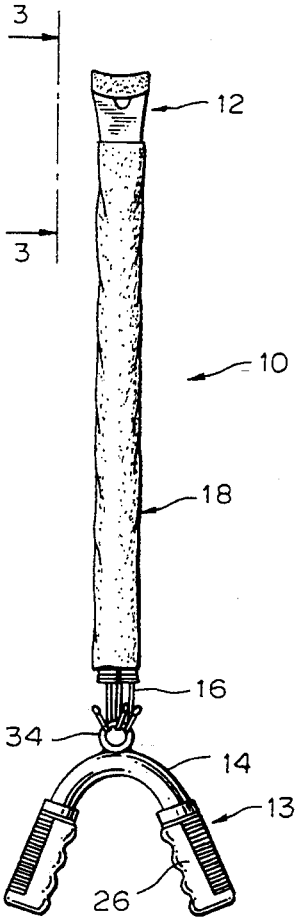
FIG. 1 is a front view of one embodiment of the facial exercise device of the present invention.
Figure 2:
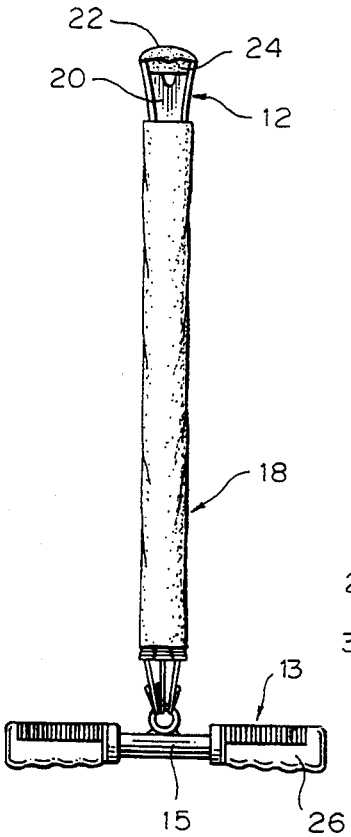
FIG. 2 is a rear view of a facial exercise device in accordance with the present invention having a second embodiment or handle.
Figure 4:
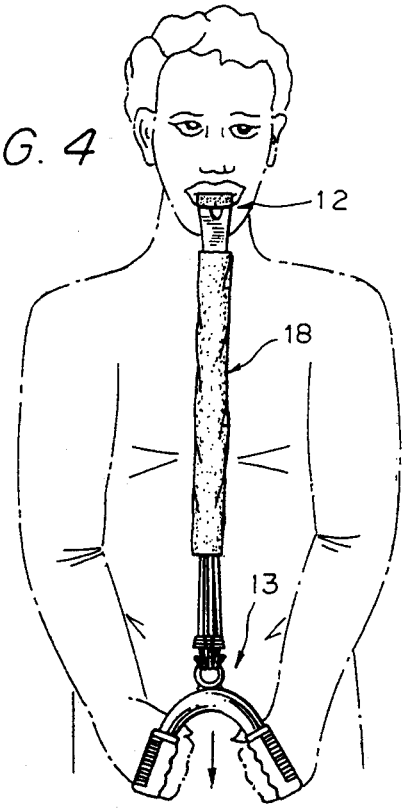
FIG. 4 is a front view of an individual using the device of the present invention.
Figure 5:
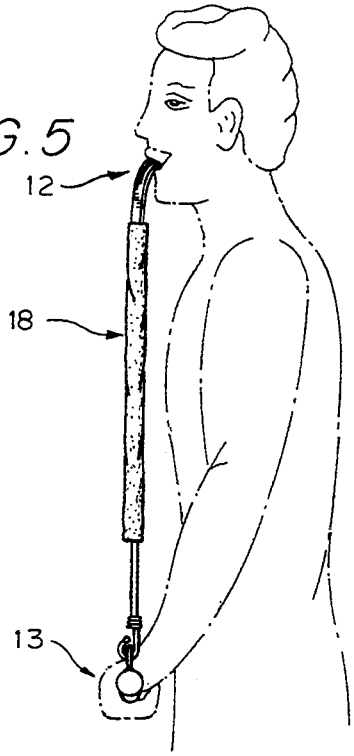
FIG. 5 is a side view of an individual using the device of the present invention.

The handle portion 13 of the device may assume any of various shapes. In FIG. 1, the handle 14 has a bent shape which can be gripped as shown in FIG. 4. The handle 14 includes a connected loop 34 through which the lower hooks 16 of the elastic members 32 may be inserted. The handle 14 also preferably includes handle grips 26. The handle 14 is preferably made of metal and the handle grips 26 of plastic material. In FIG. 2, the handle 15 is shown as being straight rather than curved, and the manner of gripping handle 15 is shown in FIG. 5.

When in use, one or more of the BUNGEE cords 32 are attached to the mouthpiece 12 and to the handle 13. The number of BUNGEE cords 32 which are connected will depend on the amount of resistance which is desired for the particular exercise. The mouthpiece 12 is placed in the user's mouth hooking over the user's front lower teeth. The handle 14 or 15 may be gripped in the user's hands, as shown in FIGS. 4 and 5. Alternatively, a straight handle such as 15 may be placed under the user's thighs when in a sitting position or, if long BUNGEE are used, may be placed under the user's feet while in a standing position.

There are several exercises which may be performed with the facial exercise apparatus of the present invention. The basic one is to place the appliance 12 in the mouth and move the lower jaw by making a chewing motion. This motion is being resisted by the elastic BUNGEE cords 32 which produce a downward force on the lower jaw. Another very beneficial exercise is to have the appliance 12 in the mouth and to "thrust" the jaw back and forward. This conditions the muscles between the Adam's apple and the chin.

For neck exercises, the user bites into the appliance so that the lower jaw does not move. By positioning the handle either under the user's legs or to one side or the other, a variety of neck exercises may be performed.

Exercises for the face are somewhat similar to the ones done for the body, in that the user should perform three sets of 10–12 repetitions for any given exercise and then go on to the next exercises. This routine should be repeated every other day or three days a week. In order for this program to be most effective, a series of 50 or so isometric/isotonic exercises should be performed on the off-days, i.e., the days between the actual exercise sessions with the appliance.

It should be understood that the apparatus as illustrated is for the purpose of example only. The exact shape and conformation of the device as illustrated may not be critical. It is important, however, that the mouthpiece 12 have a hook-shaped region 24 which will overhang at least the front teeth of the lower jaw, thereby permitting transfer of generally downward pressure to the lower jaw. While in a preferred embodiment the mouthpiece 12 is shaped to correspond to the shape of the curvature of the front of the lower jaw, such curvature is not critical as long as the appropriate hooked overhang is achieved.

While the spring portion 18 is illustrated as comprising a plurality of BUNGEE cords 32, any material which will provide an elastic resistance may be used, such as springs, rubber bands, etc.

Similarly, the particular shape of the handle is not critical. Indeed, the handle may be entirely omitted and the bottom of the elastic means connected directly to a connection on the floor. It is only important that the bottom of the elastic device be anchored in some way in order to permit the resistance exercises to be conducted by the jaw.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

I claim:

1. A facial muscle exercise apparatus, comprising:

a mouthpiece having a one-piece configuration with a downwardly extending portion at one end adapted to remain outside of the mouth of the user when in use, and an overhanging portion at an opposite end which is curved into a substantially U-shape so as to overhang the front teeth of the lower jaw when in use, wherein said mouthpiece will maintain its position inside the user's mouth without the user clamping his teeth on the overhanging portion when a traction force is applied; and traction means connected to the downwardly extending portion of said mouthpiece, for applying downwardly directed traction force to the mouthpiece, and hence to the jaw of the user, when in use.

2. An apparatus in accordance with claim 1, further including handle means connected to said spring-like device at the end opposite the end connected to said mouthpiece.

3. An apparatus in accordance with claim 1, wherein said traction means comprises a spring-like device which will stretch upon tensile stress and is biased to return to its starting length, said spring-like device having two ends, one of which is connected to the downwardly extending portion of said mouthpiece.

4. An apparatus in accordance with claim 3, wherein said spring-like device comprises elastic cords.

5. An apparatus in accordance with claim 1, wherein said mouthpiece comprises a metal core and an overlay made of elastomeric plastic.

6. An apparatus in accordance with claim 1, wherein said mouthpiece is generally shaped to correspond to the shape of the curvature of the front of the lower jaw.

* * * * *